US006386242B1

(12) United States Patent
Higashinaka et al.

(10) Patent No.: US 6,386,242 B1
(45) Date of Patent: May 14, 2002

(54) HOOK FASTENER MEMBER TO MINIMIZE DAMAGE TO LOOPS

(75) Inventors: Yukitoshi Higashinaka, Fukui-ken; Hiroshi Itoh, Osaka-fu, both of (JP)

(73) Assignee: Kuraray Co., Ltd., Kurashiki (JP)

( * ) Notice: Subject to any disclaimer, the term of this patent is extended or adjusted under 35 U.S.C. 154(b) by 2 days.

(21) Appl. No.: 09/618,844

(22) Filed: Jul. 18, 2000

(30) Foreign Application Priority Data

Jul. 30, 1999 (JP) ..... 11-216238

(51) Int. Cl.[7] ..... A44B 18/00
(52) U.S. Cl. ..... 139/391; 24/445
(58) Field of Search ..... 24/445; 139/384 B, 139/391

(56) References Cited

U.S. PATENT DOCUMENTS 3,594,873 A * 7/1971 Hockmeyer, Jr. ..... 139/391
5,349,991 A * 9/1994 Okawa et al. ..... 139/391
5,515,583 A * 5/1996 Higashinaka ..... 24/446
6,202,264 B1 * 3/2001 Ishihara ..... 24/445

FOREIGN PATENT DOCUMENTS

JP 6-52521 7/1994

* cited by examiner

*Primary Examiner*—Andy Falik
(74) *Attorney, Agent, or Firm*—Oblon, Spivak, McClelland, Maier & Neustadt, P.C.

(57) ABSTRACT

A flexible hook fastener member having a hook density of 80 to 200 per $cm^2$ and causing little damage to cooperating loop fastening elements. The loops for forming hook fastening elements are produced by thin monofilaments having a fineness of 100 to 200 deniers. The monofilament for forming the hook fastening elements are in reverse phase relation to the adjacent ground warps with respect to the ground wefts.

8 Claims, 2 Drawing Sheets

HOOK FASTENER MEMBER TO MINIMIZE DAMAGE TO LOOPS

BACKGROUND OF THE INVENTION

1. Field of the Invention

The present invention relates to a separable fastener comprising a hook fastener member having hook fastening elements and a loop fastener member having loop fastening elements, and more particularly, to a separable fastener in which the damage to loop fastening elements to be engaged with the hook fastening element is minimized by a hook fastener member provided with specific hook fastening elements projecting from the base thereof.

2. Description of the Prior Art

Separable fasteners in which hook fastening elements (hereinafter may be referred to simply as "hooks") and loop fastening elements (hereinafter may be referred to simply as "loops") are engaged with each other to form fastening have been utilized in various applications. The separable fasteners have been developed as alternative means for other fastening means such as hook-and-eye and string-binding, and recently, separable fasteners having a strong engaging force have been developed and practically used.

However, with the recent spread of applications of the separable fasteners, there is an increasing demand for a hook fastener member causing little damage to cooperating loops in addition to their high engaging force. In clothing applications of the separable fasteners, particularly in the application to thin clothing or clothing for wearing close to the skin of a user, a cooperating loop fastener member needs to be thin and flexible. Thus, the hook fastener members used in these applications are required to cause little damage to loops. In some applications of the separable fasteners, a non-woven fabric capable of engaging with the hook fastener member has come to be used as an alternative for the loop fastener members. In such applications, the hook fastener members are also required to cause little damage to the engaging surface of the non-woven fabric. To meet the above demands, Japanese Utility Model Application Laid-Open No. 6-52521 discloses an flexible hook fastener member with little damage to loops.

SUMMARY OF THE INVENTION

As a result of studies on the flexible hook fastener member of Japanese Utility Model Application Laid-Open No. 6-52521, the inventors have recognized that the conventional hook fastener members must be further improved in preventing loop damage since they still caused a considerable damage to loops.

Thus, the present invention provides a hook fastener member with little damage to cooperating loop fastening elements, having hook fastening elements in a hook density of 80 to 200 per $cm^2$, the hook fastening elements being formed from hook-forming loops made of a monofilament having a fineness of 100 to 200 deniers, and the monofilament and ground warps which are adjacent to the monofilament being placed in a reverse phase (position) with respect to a ground weft by weaving. The hook fastening elements are preferably arranged in the lengthwise direction so as to satisfy the following relationship:

$$a:b=1:0.58 \text{ to } 1:1.75$$

wherein "a" is an inter-top distance of a pair of facing hooks and "b" is an inter-top distance of a pair of back-to-back facing hooks adjacent to the facing hooks.

The present invention also provides a separable fastener comprising a hook fastener member as mentioned above and a cooperating loop fastener member made of a knitted or woven fabric having a plurality of projecting loop fastening elements made of a multifilament having a single fiber fineness of 2 to 20 deniers in a loop density of 50 to 500 per $cm^2$.

The present invention also provides a separable fastener comprising a hook fastener member as mentioned above and a cooperating loop fastener member made of a raised non-woven fabric made of fibers having a single fiber fineness of 1 to 20 deniers and having a plurality of projecting loop fastening elements or having a plurality of raised fibers on the surface thereof.

DETAILED DESCRIPTION OF THE INVENTION

Figure 1:
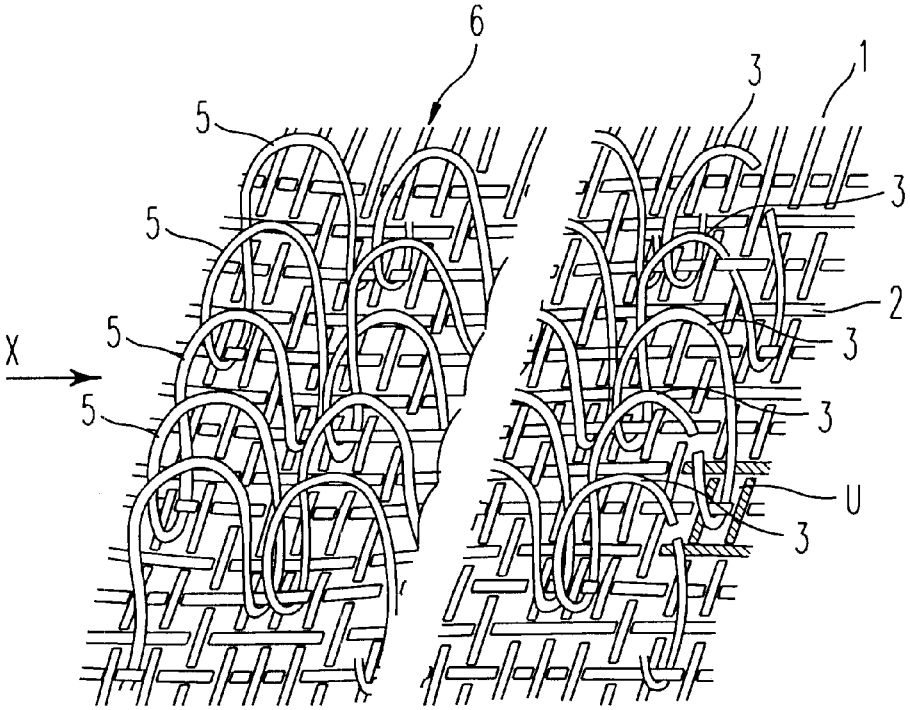
FIG. 1 is a perspective view showing the weaving structure of a hook fastener member according to the present invention.

As a result of the studies on engagement between thin, flexible loop fastener members and hook fastener members, the inventors have found that, it is necessary for preventing the damage to loops to produce individual hooks from fibers having a small fineness, thereby reducing the engaging force of the hooks, and increase the number of hooks present in a given area to compensate the reduced engaging force of the individual hooks, thereby retaining the overall engaging force of the separable fastener to a sufficient level.

However, a hook fastener member thus constructed showed only a limited improvement in reducing loop damage. As a result of further studies, the inventors have found that a uniform arrangement of hooks is important. Specifically, in separable fasteners having a high hook density, a plurality of non-uniformly arranged hooks engage with a single loop to create an excessively high engaging force, thereby likely to cause breaking of the loop. Thus, the inventors have finally found that the prevention of damage to loops cannot be achieved by merely considering the fineness and density of hooks, but can be achieved by considering a uniform arrangement of hooks in combination with the fineness and density.

The hook fastener member of the present invention is produced by weaving hook-forming monofilaments having a fineness of 100 to 200 deniers with ground warps and ground wefts for constituting a base fabric of the member. Although not critical, the monofilaments, ground warps and ground wefts are preferably made of a polyamide such as nylon 6 and nylon 66 or a polyester such as polyethylene terephthalate. The density of hook-forming loops made of the monofilaments is 80 to 200 per $cm^2$. Since the hooks of the present invention are made of the monofilaments having a very small fineness, the individual hooks produce a low engaging force. To compensate the low engaging force of the individual hooks, the high hook density specified above is required. When the hook density is less than 80 per $cm^2$, the overall engaging force is insufficient. When the hook density is more than 200 per $cm^2$, the dense hooks prevent the cooperating loop fastening elements from penetrating between the hooks, thereby reducing the overall engaging force.

As a result of studies on forming the hook-forming loops at a high density on the base fabric, the present inventors have recognized that the weaving structure of the hook fastener member is important, and have made further studies as described below.

The known hook fastener members including those described in Japanese Utility Model Application Laid-Open No. 6-52521 have a weaving structure where hook-forming monofilaments (warps) are interlaced between plain-woven ground warps. It has been considered that the hook-forming monofilaments in this weaving structure are tightened by a plurality of ground warps, and therefore, firmly anchored to the base fabric.

However, if the displacement of the hook-forming monofilaments in the woven separable fastener occurs before a resin back-coating process, the hook-forming loops on the base fabric change their positions to result in poor uniformity of the hook arrangement. In the weaving structures of known hook fastener members, a ground warp, which is present together with a hook-forming monofilament in the same unit area of ground weave, sometimes changes its position. This displacement of the ground warp deforms the shape of hook-forming loop in the same unit area of ground weave even though the hook-forming monofilament itself does not change its position, thereby resulting in poor uniformity of the resultant hook arrangement. The displacement of the hook-forming monofilaments or the ground warps affects the uniform arrangement of hooks particularly in the lengthwise direction, and the uniformity in the transverse direction undergoes substantially no change because the transverse arrangement is governed by the ground weave structure of the base fabric. Thus, it has been found by the inventors that the uniform arrangement of hooks is subject to change only in the lengthwise direction. However, no studies have been hitherto made thereon.

In the weaving structure of the known hook fastener members, a hook-forming monoflament (warp) and one of its adjacent ground warps are in the same phase, i.e., in parallel weave condition with respect to the ground warps. Therefore, the coarse rigid hook-forming monofilament tends to shift toward the paralleled ground warp and make the intersecting ground weft easy to displace. Thus, it has been found that such a weaving structure of the known hook fastener member makes the loop-forming monofilament difficult to form a uniform arrangement of hook-forming loops.

In the weaving structure of the hook fastener member of the present invention, the hook-forming monofilament is in reverse phase (Position) relation to both the ground warps adjacent to the monofilament with respect to the intersecting ground weft. Namely, in the intersecting portions, the hook-forming monofilament passes under the intersecting ground weft while both the adjacent warps pass over the same intersecting ground warp. With this weave structure, only the hook-forming monofilament is present in a given unit area of the ground weave structure, so that the hook-forming monofilament is firmly anchored to the ground weave due to the absence of the ground warp in the same unit area, thereby considerably reducing the possible displacement of the hook-forming monofilament before back-coating process. As a result, the hook arrangement in such a weaving structure has a drastically improved uniformity as compared to those in the known high-density hook fastener members.

In the known hook fastener members with plain weave structure, thicker hook-forming monofilaments having a fineness of 220 deniers or more are generally used and the hook density is less than 80 per $cm^2$. In such known hook fastener members, it is intended to achieve a high engaging force by the use of high-tenacity hook engaging elements. In the present invention, a ground weave structure quite different from those of the prior art and a hook-forming monofilament having a fineness thinner than those employed in the prior art are used. Thus, the present invention has pursued an object not realized in the prior art and achieved results not obtained in the prior art.

In the present invention, the degree of uniformity of the hook arrangement on the hook fastener members is determined as follows.

On a ×50 photograph of a lengthwise cross section of a hook fastener member, a hook top distance (a) (FIG. 3) of a facing pair of hooks and a hook top distance (b) (FIG. 3) of its adjacent back-to-back pair of hooks were measured. From the measured values, the ratio of a:b was obtained. The measurements were repeated on arbitrarily selected 30 facing pairs and their adjacent 30 back-to-back pairs to obtain 30 respective ratios of a:b.

In the hook fastener members according to the present invention, the hooks are arranged in the lengthwise direction so as to have a ratio of a:b in the range of preferably 1:0.58 to, 1:1.75, more preferably 1:0.60 to 1:1.70, and further preferably 1:0.65 to 1:1.60. In the present invention, a:b= 1:0.58 to 1:1.75 means that the average of 30 respective ratios of a:b falls within the range of 1:0.58 to 1:1.75 and simultaneously a half or more of 30 respective ratios are within this range. When a:b is outside the above range of 1:0.58 to 1:1.75, particularly in a high-density hook fastener member, adjacent hooks are positioned so close to each other that a plurality of adjacent hooks integrally act as single hook made of a monofilament with larger deniers, thereby likely to cause increased damage of cooperating loops.

The present invention will be described by referring to the accompanying drawings.

FIG. 1 is a perspective view showing the weaving structure of one of the most preferred hook fastener members according to the present invention. A ground warp 1 and a ground weft 2 each forming a base fabric of a hook fastener member are integrally interlaced with each other together with a hook-forming monofilament 3. Each loop formed by the hook-forming monofilament 3 is cut at any single portion between a loop top and a loop bottom to form hooks. Each loop not cut, forms a projecting loop fastening element 5, and if the fastening member has uncut loop, then the member is used as a cooperating loop fastener member 6. The numbers of the ground warps and the ground wefts may be suitably selected. In the illustrated embodiment, only one hook-forming monofilament 3 is present in a unit area U defined by a pair of adjacent ground warps and the nearest couple of ground wefts other than the ground weft intersecting the hook-forming monofilament (area surrounded by hatched warps and wefts as shown in FIG. 1). Further, both the ground warps 1 adjacent to the hook-forming monofilament 3 are in reverse phase relation to the monofilament 3 with respect to the ground weft 2 in the intersecting portions. Namely, the monofilament passes under the ground weft while the adjacent ground warps pass over the ground weft.

Figure 2:
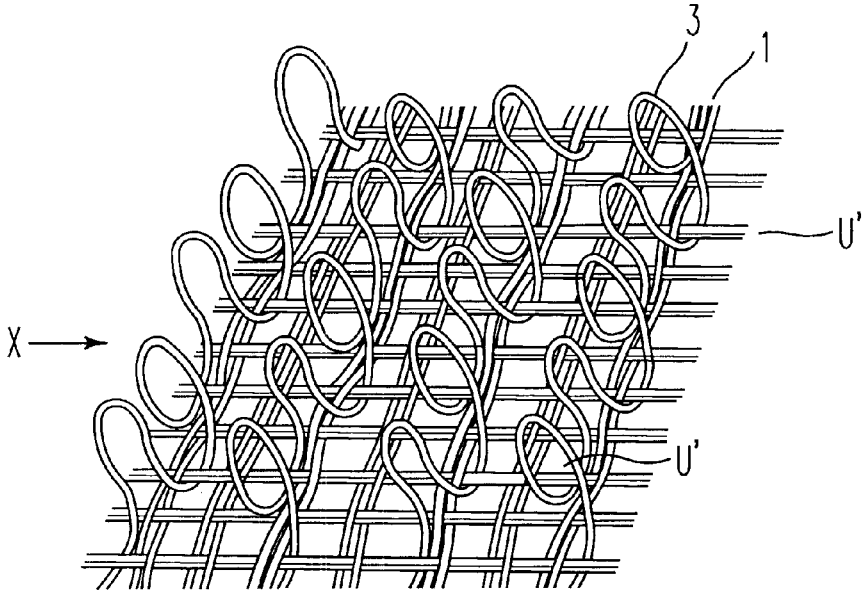
FIG. 2 PRIOR ART
FIG. 2 is a perspective view showing the weaving structure of a conventional high-density hook fastener member.

FIG. 2 is a perspective view showing the weaving structure of a known high-density hook fastener member. U' is a unit area comparable to the unit area U of FIG. 1. In the unit area U', at least one ground warp 1 is present together with the hook-forming monofilament at the position proximate to or apart from the monofilament. Therefore, when the monofilament and/or the ground warp or warps change the position in the unit area, the position of the monofilament in the base fabric is changed and, as a result, the loop formed by the monofilament is also displaced.

Figure 3:
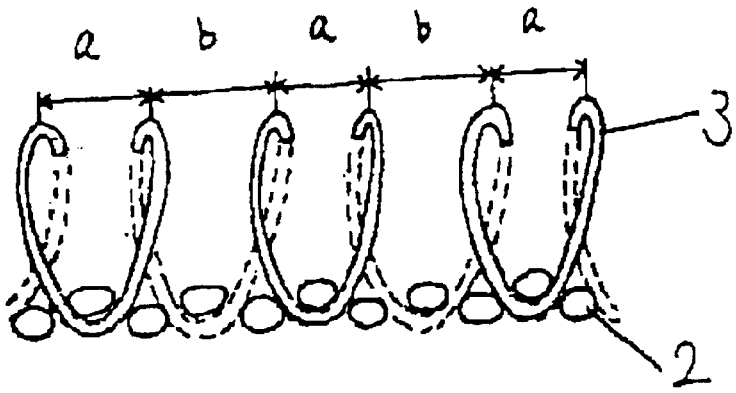
FIG. 3 is an enlarged schematic sectional view showing the lengthwise arrangement of hook-forming loops according to the present invention.

FIG. 3 is an enlarged schematic sectional view showing a lengthwise arrangement of the hook-forming loops according to the present invention, viewed along the direction indicated by an arrow X of FIG. 1. The monofilament 3 interlaced with the ground wefts 2 forms a plurality of loops. One loop provides one hook by cutting as shown by a solid line. The distance between the tops of a facing pair of adjacent hooks is designated as a hook top distance (a), and the distance between the tops of a back-to-back pair of adjacent hooks is designated as a hook top distance (b). In the present invention, the words, "facing pair of adjacent hooks" and "back-to-back pair of adjacent hooks", may include not only the pairs of adjacent hooks exactly facing or facing back to back but also the pairs of adjacent hooks slantly facing or facing back to back at an angle as shown in FIG. 1.

Figure 4:
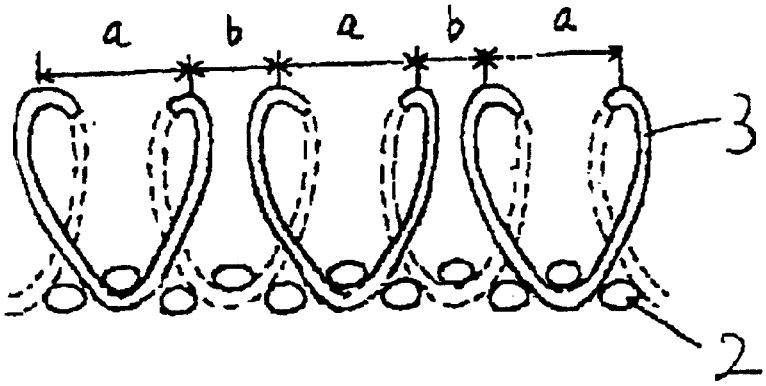
FIG. 4 Prior Art
FIG. 4 is an enlarged schematic sectional view showing the lengthwise arrangement of hook-forming loops of the conventional high-density hook fastener member.

FIG. 4 is an enlarged schematic sectional view showing the lengthwise arrangement of loops of a known high-density hook fastener member, viewed along the direction indicated by an arrow X in FIG. 2. Similarly to FIG. 3, the distance between the tops of a facing pair of adjacent hooks is designated as a hook top distance (a), and the distance between the tops of back-to-back pair of adjacent hooks is designated as a hook top distance (b). Upon comparing with FIG. 3, it would appear that a:b of FIG. 4 is different from that of FIG. 3.

In the present invention, the hook-forming loops are preferably formed as shown in FIG. 1. For example, a hook-forming monofilament passes alternately under one or more ground wefts (one weft in FIG. 1) and over one or more adjacent ground wefts (one adjacent weft in FIG. 1) to provide a floating section which forms a loop.

In 3-1 ground weave structure as shown in FIG. 1, a triple warp consisting of three successively adjacent warp yarns alternately passes under a ground weft and over the next ground weft, and a single warp adjacent to the triple warp is interwoven with the ground wefts in reverse manner, namely the single warp passes over the ground weft which is carried over the triple warp and vice versa. The hook-forming monofilament 3 for forming hook-forming loops is interlaced between the warp yarns constituting the triple warp and intersects every other ground weft 2 in reverse manner to the triple warp. One of the loop bottoms is present in a triple warp and the other in the next triple warp beyond the adjacent single warp. Thus, each hook-forming loop is preferred to have its bottoms at different positions determined by different ground warp and different ground weft.

Although 3-1 ground weave structure as mentioned above is most preferable, the base fabric may be in 2-1, 4-1, 2-2 or 3-2 ground weave structure. Since the hook-forming monofilament cannot be in reverse phase relation to the adjacent ground warps, 1-1 plain ground weave structure is not preferred in the present invention.

The ground weft may be a single yarn or consist of two or more yarns.

The hook fastener member of the present invention is used in combination with a loop fastener member or a non-woven fabric having a loop-carrying surface. Although known loop fastener member generally used in the art can be used, a loop fastener member having loops formed by multifilaments with a small single fiber fineness of 2 to 20 deniers in a loop density of 50 to 500 per $cm^2$ is preferable in view of ensuring the effects of the present invention. Examples of materials for the multifilaments include a polyamide such as nylon 6 and nylon 66 and a polyester such as polyethylene terephthalate, although not limited thereto. A non-woven fabric formed by short or long fibers with a single fiber fineness of 1 to 20 deniers having a plurality of projecting loops on its surface is also preferable. The loops of non-woven fabrics may include, in addition to loops in a strict sense, engaging elements having a long fiber end capable of engaging with hooks. The non-woven fabric may be made of any of natural fibers such as cotton and wool, regenerated or semi-synthetic fibers such as rayon and acetate, and synthetic fibers such as nylon fibers, polyester fibers, acrylic fibers, polyolefin fibers, although not limited thereto. Synthetic fibers are preferred because highly resistant to damage by the hooks. Either of entangled non-woven fabrics made of short fibers entangled by needle punch, etc. and spun bonded fabrics made of long fibers may be used in the present invention.

The performance of the hook fastener member of the present invention was measured according to JIS L 3416 by engaging with a loop fastener member. The results showed that the bonding strength and the retention of bonding strength were equal to or higher than those of a known high-density hook fastener member, and the degree of damage to the base fabric of a cooperating loop fastener member was extremely low as compared to that of the known high-density hook fastener member even after 2,000 repeated engagement-disengagement.

The damage to a base cloth to which the separable fastener was attached was evaluated by a method of JIS L 1096, 6.17 E (Martindale's method). The hook fastener member to be measured was attached to a sample holder, and the base cloth was mounted on a control abrasion cloth. After abrading the base cloth with the hook fastener member 50 times, the degree of damage of the base cloth was evaluated by its appearance. As a result, it was confirmed that the hook fastener member of the present invention caused little damage to the base cloth as compared with the known high-density hook fastener member.

The present invention will be described in more detail with reference to the following examples.

EXAMPLE 1 AND COMPARATIVE EXAMPLE 1

An uncut loop-carrying woven tape having a weaving structure as shown in FIG. 1 was produced using nylon 66 yarn of 140d/14f as the ground warp 1, nylon 66 yarn of 110d/24f as the ground weft 2 and nylon 66 yarn of 120d/1f as the hook-forming monofilament 3 (hook-forming loop yarn). In the present invention, "a yarn of 140d/14f", for example, means a multifilament yarn made of 14 monofilaments and the fineness of the multifilament yarn is 140 deniers. After the woven tape was heat-set and back-coated by known methods, loops were cut to form hooks, thereby obtaining a hook fastener member of the present invention having a hook density of 143 per $cm^2$ and a degree of uniformity of the lengthwise hook arrangement (a:b) of 1:1.35.

Using the same yarns as described above, an uncut loop-carrying woven tape having a weaving structure as shown in FIG. 2 was produced. Then, the woven tape was subjected to the same treatments as above, thereby obtaining a comparative high-density hook fastener member (Comparative Example 1) having a hook density of 143 per $cm^2$ and a degree of uniformity of the lengthwise hook arrangement (a:b) of 1:0.51.

Using a raised tricot cloth made of nylon 6 multifilaments of 110d/18f with a single fiber fineness of 6.1 deniers and having a loop density of 250 per $cm^2$ as a cooperating loop fastener member, the bonding strength, degree of damage to loop fastener member after repeated engagement-disengagement, and degree of damage to a base cloth (knitted fabric of finished yarns) were evaluated. The results are shown in Table 1.

As seen from Table 1, as compared with the comparative hook fastener member, the hook fastener member of the present invention exhibited a high initial bonding strength and a high bonding strength after repeated engagement-disengagement and caused little damage to both the loop fastener member and the base cloth.

TABLE 1

| | | Example 1 | Comparative Example 1 |
|---|---|---|---|
| Bonding strength | Tensile shearing strength ($N/cm^2$) | 2.65 | 2.55 |
| | Peeling strength (N/cm) | 0.47 | 0.42 |
| Retention of bonding strength | Ater 2,000 repetition (%) | 93 | 85 |
| Damage to loops | After 2,000 repetition Evaluation by appearance* | 5 | 4 |
| Damage to base cloth | Martindale's method Ater 50 repetition Evaluation by appearance* | 2 to 3 | 1 to 2 |

*The appearance was evaluated by ratings of JIS L 1076 where 1 is significant pilling occurrence and 5 is little pilling.

EXAMPLE 2 AND COMPARATIVE EXAMPLE 2

A hook fastener member of the present invention (Example 2) and a comparative high-density hook fastener member (Comparative Example 2) were prepared in the same manner as in Example 1 except that nylon 66 yarn of 100d/1f was used as the hook-forming loop yarn. The hook density was 187 per $cm^2$ for both the hook fastener members, and the degree of uniformity of the lengthwise hook arrangement (a:b) was 1:0.80 for the inventive hook fastener member and 1:0.40 for the comparative hook fastener member. Using a needle-punched fabric made of polyester yarns having a single fiber fineness of 3 deniers as a cooperating loop fastener member, the bonding strength, retention of bonding strength and degree of damage to loop fastener member after repeated engagement-disengagement were evaluated. The results are shown in Table 2.

As seen from Table 2, as compared with the comparative hook fastener member, the hook fastener member of the present invention exhibited a good bonding strength and retention of bonding strength and caused little damage to the loop fastener member.

TABLE 2

| | | Example 2 | Comparative Example 2 |
|---|---|---|---|
| Bonding strength | Tensile shearing strength ($N/cm^2$) | 2.11 | 1.89 |
| | Peeling strength (N/cm) | 0.35 | 0.30 |
| Retention of bonding strength | Ater 2,000 repetition (%) | 71 | 50 |
| Damage to loops | Ater 2,000 repetition Evaluation by appearance* | 3 | 2 |

*The appearance was evaluated by ratings of JIS L 1076 where 1 is significant pilling occurrence and 5 is little pilling.

As described above, the present invention provides dense, flexible hook fastener members with little damage to loop fastening elements. The hook fastener members of the present invention can be used in combination not only with an ordinary loop fastener members but also with other loop fastener members having a high loop density or raised non-woven fabrics, with drastic reduction in damage to loops.

What is claimed is:

1. A hook fastener member with damage to the to cooperating loop fastening elements minimized, comprising:

hook fastening elements in a hook density of 80 to 200 per $cm^2$, the hook fastening elements being formed from hook-forming loops which are formed by a monofilament having a fineness of 100 to 200 deniers, and the monofilament and ground warps which are adjacent to both sides of the monofilament being placed in a reverse phase with respect to a ground weft by weaving.

2. The hook fastener member according to claim 1, wherein the hook fastening elements are arranged in the lengthwise direction so as to satisfy the following relationship:

$$a:b=1:0.58 \text{ to } 1:1.75$$

wherein "a" is an inter-top distance of a pair of facing hooks and "b" is an inter-top distance of a pair of back-to-back facing hooks adjacent to the facing hooks.

3. A separable fastener comprising a hook fastener member as defined in claim 1 and a cooperating loop fastener member.

4. The separable fastener according to claim 3, wherein the cooperating loop fastener member is a knitted or woven fabric having a plurality of projecting loop fastening elements made of a multifilament having a single fiber fineness of 2 to 20 deniers in a loop density of 50 to 500 per $cm^2$.

5. The separable fastener according to claim 3, wherein the cooperating loop fastener member is a raised non-woven fabric made of fibers having a single fiber fineness of 1 to 20 deniers and having a plurality of projecting loop fastening elements or having a plurality of projecting fibers.

6. A separable fastener comprising a hook fastener member as defined in claim 2 and a cooperating loop fastener member.

7. The separable fastener according to claim 6, wherein the cooperating loop fastener member is a knitted or woven fabric having a plurality of projecting loop fastening elements made of a multifilament having a single fiber fineness of 2 to 20 deniers in a loop density of 50 to 500 per $cm^2$.

8. The separable fastener according to claim 6, wherein the cooperating loop fastener member is a raised non-woven fabric made of fibers having a single fiber fineness of 1 to 20 deniers and having a plurality of projecting loop fastening elements or having a plurality of projecting fibers.

* * * * *